US006427736B1

(12) United States Patent
Meraldi et al.

(10) Patent No.: US 6,427,736 B1
(45) **Date of Patent: *Aug. 6, 2002**

(54) CELLULOSE FIBER FOR TIRE

(75) Inventors: Jean-Paul Meraldi; Rima Huston; Vlastimil Cizek, all of Zurich (CH)

(73) Assignee: Michelin et Cie, Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,216

(22) Filed: Apr. 16, 1999

Related U.S. Application Data

(63) Continuation of application No. PCT/EP97/05675, filed on Oct. 15, 1997.

(30) Foreign Application Priority Data

Oct. 18, 1996 (FR) ..... 9612870

(51) Int. Cl.[7] ..... B60C 9/00; D01F 2/02

(52) U.S. Cl. ..... 152/151; 152/451; 428/364; 428/393; 536/56

(58) Field of Search ..... 152/451, 151; 536/56; 428/393, 364

(56) References Cited

U.S. PATENT DOCUMENTS

| | | | | |
|---|---|---|---|---|
| 3,767,756 | A | * | 10/1973 | Blades |
| 4,370,168 | A | | 1/1983 | Kamide et al. |
| 4,486,119 | A | | 12/1984 | Kamide et al. |
| 4,746,694 | A | * | 5/1988 | Charbonneau et al. |
| 4,839,113 | A | | 6/1989 | Villaine et al. |
| 5,817,801 | A | * | 10/1998 | Boerstoel et al. ..... 536/56 |
| 5,938,971 | A | * | 8/1999 | Hutson et al. ..... 428/393 |
| 6,014,997 | A | * | 1/2000 | Boerstoel et al. ..... 152/451 |
| 6,093,490 | A | * | 7/2000 | Meraldi et al. ..... 428/393 |
| 6,342,296 | B1 | * | 1/2002 | Meraldi et al. |

FOREIGN PATENT DOCUMENTS

| | | | |
|---|---|---|---|
| FR | 2465763 | | 4/1981 |
| NL | 54859 | | 2/1943 |
| WO | WO8505115 | | 11/1985 |
| WO | WO9606207 | | 2/1996 |
| WO | WO 96/06208 | * | 2/1996 |
| WO | WO9609356 | | 3/1996 |

* cited by examiner

*Primary Examiner*—Steven D. Maki
(74) *Attorney, Agent, or Firm*—Baker Botts L.L.P.

(57) ABSTRACT

The invention concerns a coagulating agent for liquid crystal solutions with a base of cellulose substances, characterised in that it contains at least one water soluble additive selected from the group consisting of ammonia, amines of salt of these compounds, the additive being such that the pH of the said coagulating agent is greater than 6. A preferable additive is a salt elected from the group consisting of ammonium formates, acetates and phosphates, mixed salts of these compounds, or mixtures of these constituents, in particular diammonium orthophosphates $(NH4)_2$ $HPO_4$. The invention also concerns a method for spinning a liquid crystal solution with a base of cellulose substances, using a coagulating agent as per the invention, in particular the method called the "dry-jet-wet-spinning" as well as spun articles, fibers or films, obtained by these methods. The invention further concerns a cellulose fiber having toughness higher than 40 cN/tex, an initial modulus of elasticity higher than 1200 cN/tex and high fatigue strength: its breaking load degeneration ΔF after 350 fatigue cycles in the so-called "specimen test", under a compression rate of 3.5% and a tensile stress of 0.25 cN/tex, is less than 30%.

6 Claims, No Drawings

CELLULOSE FIBER FOR TIRE

This is a continuation-in-part of copending international application Ser. No. PCT/EP97/05675 filed Oct. 15, 1997 now WO98/17847 published Apr. 30, 1998.

BACKGROUND OF THE INVENTION

The present invention relates to cellulose materials, i.e. to cellulose or to cellulose derivatives, to liquid-crystal solutions based on such cellulose materials, in particular to spinnable solutions capable of yielding, after coagulation, spun articles such as fibres or films, to these spun articles themselves, and also to processes for obtaining such spun articles.

The invention relates more particularly to an aqueous coagulating agent suitable for coagulating liquid-crystal solutions based on cellulose materials, the use of such a coagulating agent for coagulating such solutions, in particular in a spinning process, and also to a novel cellulose fibre having an unexpected combination of mechanical properties.

SUMMARY OF THE INVENTION

It has been known for a long time that the production of liquid-crystal solutions is essential for obtaining fibres having high or very high mechanical properties by spinning, as has been shown in particular by Patents U.S. Pat. No. 3,767,756, which relates to aramid fibres, and U.S. Pat. No. 4,746,694, which relates to aromatic polyester fibres. The spinning of liquid-crystal solutions of cellulose also makes it possible to obtain fibres having high mechanical properties, in particular by what is called the "dry-jet-wet spinning" processes, as described, for example, in International Patent Applications PCT/CH85/00065 and PCT/CH95/00206 for liquid-crystal solutions based on cellulose and at least one phosphoric acid.

Patent Application PCT/CH85/00065, published under No. WO85/05115, or its equivalent patents EP-B-179 822 and U.S. Pat. No. 4,839,113, describe the obtaining of spinning solutions based on cellulose formate, by reacting the cellulose with formic acid and phosphoric acid, these solutions being in the liquid-crystal state. These documents also describe the spinning of these solutions using what is called the "dry-jet-wet spinning" technique to obtain cellulose formate fibres, as well as cellulose fibres regenerated from these formate fibres.

Patent application PCT/CH95/00206, published under No. WO96/09356, describes a method for dissolving cellulose directly, without formic acid, in a solvent in order to obtain a liquid-crystal solution, this solvent containing more than 85% by weight of at least one phosphoric acid. The fibres obtained after spinning this solution are fibres of non-regenerated cellulose.

Compared with conventional cellulose fibres such as rayon or viscose fibres, or with other conventional non-cellulose fibres, such as nylon or polyester fibres, for example, all spun from optically isotropic liquids, the cellulose fibres described in these two applications WO85/05115 and WO96/09356 are characterised by a far more ordered or oriented structure, owing to the liquid-crystal nature of the spinning solutions from which they have originated. They have very high mechanical properties in extension, in particular toughnesses of the order of 80 to 120 cN/tex, or even more, and initial moduli which may exceed 2500 to 3000 cN/tex.

However, the processes described in the above two applications for obtaining these fibres having very high mechanical properties all have the same disadvantage: the coagulation step is performed in acetone.

Now, acetone is a relatively costly, volatile product, which furthermore has a risk of explosion which requires special safety measures. Such disadvantages are furthermore not peculiar to acetone, but in fact common to numerous organic solvents used in the spinning industry, in particular as coagulating agents.

It was therefore entirely desirable to find an alternative to the use of acetone by replacing it with a coagulating agent which would be more advantageous from an industrial point of view and easier to use, even at the expense of a reduction of certain mechanical properties of the fibres obtained, particularly since the very high mechanical properties described above may be excessive for certain technical applications.

Although it has proved technically possible to replace the acetone with water to coagulate the liquid-crystal solutions described in the two applications WO85/05115 and WO96/09356 mentioned above, experience has shown that the use of water instead of acetone resulted in spinning difficulties and in cellulose fibres having very low toughness compared with those described above, this toughness scarcely ever exceeding 30–35 cN/tex, and reaching at most only 35–40 cN/tex when the fibre being formed is subjected, for example, to particularly high tensile stresses, which furthermore are detrimental to the quality of the product obtained. Such values of 30 to 40 cN/tex are in any case lower than the known toughness values of a conventional fibre of the rayon type (40–50 cN/tex), which nevertheless is obtained from a non-liquid-crystal spinning solution, i.e. one which is optically isotropic.

Thus, for spinning liquid-crystal solutions based on cellulose materials, water has proved to be a coagulating agent which is incapable of producing fibres having satisfactory mechanical properties, in particular a toughness at least equal to that of a conventional rayon fibre, for technical applications, for example for reinforcing rubber articles or tyres.

A first aim of the present invention is to propose a novel, water-based coagulating agent which is more advantageous from the industrial point of view than acetone and more effective than water alone, which is capable of producing fibres, the toughness and modulus properties of which are substantially improved compared with those of fibres coagulated simply with water.

The aqueous coagulating agent according to the invention, which is capable of coagulating a liquid-crystal solution based on cellulose materials, is characterised in that it comprises at least one water-soluble additive, selected from the group consisting of ammonia, amines or the salts of these compounds, the additive being such that the pH of said coagulating agent is greater than 6.

The invention also relates to a process for spinning a liquid-crystal solution based on cellulose materials, for obtaining a spun article, effected using a coagulating agent according to the invention, and also to any spun article obtained by such a process.

Another aim of the invention is to propose a novel cellulose fibre which may be obtained by the process according to the invention; this novel fibre, compared with a conventional rayon fibre, has a toughness at least equal to, if not greater than, a comparable fatigue strength, all combined with a significantly higher initial tensile modulus.

The cellulose fibre of the invention has the following characteristics:

its toughness T is greater than 40 cN/tex;

its initial tensile modulus Im is greater than 1200 cN/tex;

its breaking load degeneration ΔF after 350 fatigue cycles in what is called the "bar test", at a compression ratio of 3.5% and a tensile stress of 0.25 cN/tex, is less than 30%.

The invention furthermore relates to the following products:

reinforcement assemblies comprising at least one spun article according to the invention, for example, cables, plied yarns, multifilament fibres twisted on themselves, such reinforcement assemblies possibly being, for example, hybrids, composites, i.e. comprising elements of different natures, possibly not in accordance with the invention;

articles reinforced by at least one spun article and/or an assembly according to the invention, these articles being, for example, articles made of rubber or of plastics material(s), for example plies, belts, tubes or tyres, in particular tyre carcass reinforcements.

The invention and its advantages will be readily understood in the light of the following description and non-limiting examples.

DETAILED DESCRIPTION OF THE INVENTION

I. MEASUREMENTS AND TESTS USED

I-1. Degree of substitution

The degree of substitution (DS) of the fibres regenerated from a cellulose derivative, for example from cellulose formate, is measured in known manner, as indicated hereafter: approximately 400 mg of fibre is cut into pieces of a length of 2–3 cm, then weighed out with precision and introduced into a 100 ml Erlenmeyer flask containing 50 ml of water. 1 ml of normal caustic soda solution (1N NaOH) is added. The mixture is mixed at ambient temperature for 15 minutes. The cellulose is thus completely regenerated by transforming the last substituent groups which had resisted the regeneration treatment on continuous fibres into hydroxyl groups. The excess sodium hydroxide is titrated with a decinormal solution of hydrochloric acid (0.1 N HCl), and the degree of substitution is thus deduced therefrom.

I-2. Optical properties of the solutions

The optical isotropy or anisotropy of the solutions is determined by placing a drop of test solution between the linear crossed polariser and analyser of an optical polarisation microscope, followed by observing this solution at rest, that is to say in the absence of dynamic stress, at ambient temperature.

In known manner, an optically anisotropic solution, also referred to as a liquid-crystal solution, is a solution which depolarises light, that is to say, which when thus placed between a linear crossed polariser and analyser transmits light (coloured texture). An optically isotropic solution, that is to say, one which is not a liquid-crystal solution, is a solution which, under the same observation conditions, does not have the above property of depolarisation, the field of the microscope remaining black.

I-3. Mechanical properties of the fibres

The term "fibres" is understood here to refer to multifilament fibres (also called spun yarns), consisting, in known manner, of a large number of elementary filaments of small diameter (low linear density). All the mechanical properties below are measured on fibres which have undergone prior conditioning. The term "prior conditioning" is understood to refer to the storage of the fibres, before measurement, in a standard atmosphere in accordance with European Standard DIN EN20139 (temperature of 20±2° C.; moisture content of 65±2%) for at least 24 hours. For fibres of cellulose material, such prior conditioning makes it possible to stabilise their moisture content at an equilibrium level of less than 15% by weight of dry fibre.

The linear density of the fibres is determined on at least three samples, each corresponding to a length of 50 m, by weighing this length of fibre. The linear density is given in tex (weight in grammes of 1000 m of fibre).

The mechanical properties in extension (toughness, initial modulus and elongation at break) are measured in known manner using a Zwick GmbH & Co (Germany) 1435-type or 1445-type tension machine. After receiving a low prior protective twist (helical angle of about 6°), the fibres undergo tension over an initial length of 400 mm, at a nominal speed of 200 mm/min, or at a speed of 50 mm/min if their elongation at break does not exceed 5%. All the results given are an average of 10 measurements.

The toughness T (breaking load divided by linear density) and the initial tensile modulus, Im, are indicated in cN/tex (centinewtons per tex). The initial modulus Im is defined as the gradient of the linear part of the force-elongation curve, which occurs just after a standard pretension of 0.5 cN/tex. The elongation at break, referred to as Eb, is indicated as a percentage (%).

I-4. Resistance to the "bar test"

A simple test, referred to as the "bar test", is used to determine the fatigue strength of the fibres studied.

For this test, a short length of fibre (length at least 600 mm) which has been subjected to prior conditioning is used, the test being performed at ambient temperature (about 20° C.). This length, subjected to a tension of 0.25 cN/tex due to a constant weight fixed to one of its free ends, is stretched over a bar of polished steel, and curved around the latter at an angle of curvature of about 90 degrees. A mechanical device to which the other end of the length of fibre is fixed ensures forced, repeated sliding of the fibre on the polished steel bar, in an alternating linear movement of given frequency (100 cycles per minute) and amplitude (30 mm). The vertical plane containing the axis of the fibre is always substantially perpendicular to the vertical plane containing the bar, which is itself horizontal.

The diameter of the bar is selected to cause a compression of 3.5% upon each pass of the filaments of the fibre around the bar. By way of example, a bar of a diameter of 360 μm (micrometres) is used for a fibre having an average diameter of the filaments of 13 μm (or an average linear density of the filaments of 0.20 tex, for a density of cellulose of 1.52).

The test is terminated after 350 cycles, and the breaking load degeneration after fatigue, referred to as ΔF, is measured, in accordance with the equation:

$$\Delta F\ (\%)=100[F_0-F_1]/F_0$$

$F_0$ being the breaking load of the fibre before fatigue, and $F_1$ its breaking load after fatigue.

II. CONDITIONS OF CARRYING OUT THE INVENTION

First of all, the conditions for preparing the liquid-crystal solutions based on cellulose materials will be described (§II-1), then the conditions of spinning of these solutions to obtain fibres (§II-2).

II-1. Preparation of the solutions

The liquid-crystal solutions are prepared in known manner, by dissolving the cellulose materials in an appropriate solvent or solvent mixture—referred to as "spinning solvent"—as indicated, for example, in applications WO85/05115 and WO96/09356 referred to above.

"Solution" is understood here, in known manner, to mean a homogenous liquid composition in which no solid particle is visible to the naked eye. "Liquid-crystal solution" is understood to mean a solution which is optically anisotropic at ambient temperature (about 20° C.) and at rest, i.e. in the absence of any dynamic stress.

Preferably, the coagulating agent of the invention is used to coagulate liquid-crystal solutions containing at least one acid, this acid more preferably belonging to the group consisting of formic acid, acetic acid, phosphoric acids or mixtures of these acids.

The coagulating agent of the invention may advantageously be used to coagulate:

liquid-crystal solutions of cellulose derivatives based on at least one phosphoric acid, these solutions being in particular solutions of cellulose esters, in particular cellulose formate solutions, such as described, for example, in application WO85/05115 referred to above, produced by mixing cellulose, formic acid and phosphoric acid (or a liquid based on phosphoric acid), the formic acid being the esterification acid, the phosphoric acid being the solvent of the cellulose formate;

liquid-crystal solutions of cellulose based on at least one phosphoric acid, such as described for example in application WO96/09356 referred to above, prepared by directly dissolving the cellulose, i.e. without derivation, in a suitable solvent containing more than 85% by weight of at least one phosphoric acid complying with the following average formula:

$$[n(P_2O_5), p(H_2O)], \text{ with: } 0.33 < (n/p) < 1.0.$$

The starting cellulose may be in various known forms, in particular in the form of a powder, prepared for example by pulverising a cellulose plate in the raw state. Preferably, its initial water content is less than 10% by weight, and its DP (degree of polymerisation) is between 500 and 1000.

The appropriate mixing means for obtaining a solution are known to the person skilled in the art: they must be capable of correctly kneading and mixing, preferably at a controllable speed, the cellulose and the acids until the solution is obtained. The mixing can be carried out, for example, in a mixer comprising Z-shaped arms or in a mixer with a continuous screw. These mixing means are preferably equipped with a device for evacuation under vacuum and with a heating and cooling device which makes it possible to adjust the temperature of the mixer and its contents, in order to accelerate, for example, the dissolving operations, or to control the temperature of the solution during formation.

By way of example, for a cellulose formate solution, the following operating method can be used: an appropriate mixture of orthophosphoric acid (99% crystalline) and formic acid is introduced into a dual-casing mixer, comprising Z-shaped arms and an extrusion screw. Then powdered cellulose is added (the moisture content of which is in equilibrium with the ambient air humidity); the entire batch is mixed for a period of about 1 to 2 hours, for example, the temperature of the mixture being kept between 10 and 20° C. until a solution is obtained. It is possible to proceed in the same manner for a solution in accordance with application WO96/09356, by replacing the formic acid, for example, with a polyphosphoric acid.

The solutions thus obtained are ready for spinning, and can be transferred directly, for example by means of an extruder screw placed at the mixer outlet, to a spinning machine in order to be spun thereon, without any prior transformation other than usual operations such as degassing or filtration stages, for example.

II-2. Spinning of the solutions

On leaving the mixing and dissolving means, the solution is transferred in known manner towards a spinning block where it feeds a viscose pump. From this viscose pump, the solution is extruded through at least one spinneret, preceded by a filter. During its conveyance to the spinneret, the solution is gradually brought to the desired spinning temperature.

Each spinneret may comprise a variable number of extrusion capillaries, for example a single slot-shaped capillary for spinning a film, or in the case of a fibre several hundreds of capillaries, for example of cylindrical shape (diameter 50 to 80 micrometres, for example). From now on, the general case of spinning of a multifilament fibre will be considered.

On leaving the spinneret, therefore, a liquid extrudate of solution is obtained, formed of a variable number of elementary liquid veins. Preferably, the solutions are spun using the "dry-jet-wet spinning" technique using a non-coagulating fluid layer, generally air ("air-gap"), placed between the spinneret and the coagulating means. Each elementary liquid vein is stretched in this air-gap, by a factor generally of between 2 and 10 (spin-stretch factor), before penetrating into the coagulation zone, the thickness of the air-gap possibly varying to a great extent, according to the particular spinning conditions, for example from 10 mm to 100 mm.

After passing through the above non-coagulating layer, the stretched liquid veins penetrate into a coagulation device where they then come into contact with the coagulating agent. Under the action of the latter, they are transformed, by precipitation of the cellulose materials (cellulose or cellulose derivative) into solid filaments which thus form a fibre. The coagulation devices to be used are known devices, composed, for example, of baths, pipes and/or booths, containing the coagulating agent and in which the fibre being formed circulates. Preferably a coagulation bath located beneath the spinneret is used, at the exit from the non-coagulating layer. This bath is generally extended at its base by a vertical cylindrical tube, referred to as "spinning tube", in which the coagulated fibre passes and the coagulating agent circulates.

"Coagulating agent" is understood to mean in known manner an agent liable to coagulate a solution, that is to say, an agent capable of rapidly precipitating the polymer in solution, in other words, of separating it rapidly from its solvent; the coagulating agent must be both a non-solvent of the polymer and a good solvent of the solvent of the polymer.

According to the invention, the coagulating agent used is an aqueous coagulating agent comprising at least one water-soluble additive, selected from the group consisting of ammonia, amines or the salts of these compounds, the additive being such that the pH of said coagulating agent is greater than 6.

Among the additives which correspond to the above definition, mention will be made, for example, of ammonia (aqueous ammonia), aliphatic or heterocyclic amines such as ethanolamine, diethanolamine, triethanolamine, ethylenediamine, diethylenetriamine, triethylamine, imidazole, 1-methyl imidazole, morpholine and piperazine, the preferred amines being primary or secondary amines comprising 1 to 5 carbon atoms.

Preferably, an organic or inorganic ammonium salt, and more preferably a salt selected from the group consisting of formates, acetates and phosphates of ammonium, mixed salts of these compounds or mixtures of these constituents, is used as additive, this ammonium salt possibly being, in particular, a salt of an acid present in the liquid-crystal solution, for example $(NH_4)_2HPO_4$, $(NH_4)_3HPO_4$, $NaNH_4HPO_4$, $CH_3COONH_4$ or $HCOONH_4$.

Among those ammonium salts which are not suitable (pH of the coagulating agent not greater than 6), mention will be made in particular of $(NH_4)_2SO_4$, $(NH_4)HSO_4$, $(NH_4)H_2PO_4$ and $NH_4NO_3$.

The coagulating agent of the invention is preferably used on liquid-crystal solutions based on cellulose or cellulose formate dissolved in at least one phosphoric acid, such as described, for example, in applications WO85/05115 and WO96/09356 mentioned above: in this case, diammonium orthophosphate $(NH_4)_2HPO_4$ is advantageously used.

The additive concentration of the coagulating agent (referred to as Ca) may vary to a great extent, for example from 2 to 25% (% total weight of coagulating agent), or even more, according to the particular conditions of implementation of the invention.

As far as the temperature of the coagulating agent (referred to as Tc hereafter) is concerned, it has been observed that low temperatures, in particular temperatures close to 0° C., could in certain cases involve certain filaments sticking together during their formation ("married filaments"). This upsets the spinning operations and is generally detrimental to the quality of the yarn obtained; thus, preferably, the coagulating agent of the invention is used at a temperature Tc greater than 10° C., and more preferably close to ambient temperature (20° C.) or above. It has been noted that the addition of a surfactant, for example isopropanol, or phosphate-based soaps, was another possible solution for eliminating, or at least reducing, the above difficulties.

According to the process of the invention, the amount of spinning solvent supplied by the solution in the coagulating agent is preferably kept at a level lower than 10%, and even more preferably lower than 5% (% of total weight of coagulating agent), but in any case is controlled so that the pH of said coagulating agent is greater than 6, in accordance with the invention.

The total depth of coagulating agent through which the filaments pass during formation in the coagulation bath, measured from the entry to the bath to the entry to the spinning tube, may vary within a wide range, for example several millimetres to several centimetres. Nevertheless, it has been noted that an insufficient depth of coagulating agent might also involve the formation of "married filaments"; thus, preferably, the depth of the coagulating agent is selected to be greater than 20 mm.

The person skilled in the art will be able to define the most appropriate coagulating agent according to the particular characteristics of the liquid-crystal solution to be coagulated, and he will be able to adapt parameters such as additive concentration, temperature or depth of coagulating agent to the particular conditions of implementation of the invention, in the light of the following description and examples of embodiment.

Preferably, the coagulating agent according to the invention is used in what is called the "dry-jet-wet-spinning" process, as described previously, but it could also be used in other spinning processes, for example what is called a "wet-spinning" process, that is to say, a spinning process in which the spinneret is immersed in the coagulating agent.

On leaving the coagulation means, the fibre is taken up onto a drive device, for example on motorised cylinders, to be washed in known manner, preferably with water, for example in baths or booths. After washing, the fibre is dried by any suitable means, for example by continuously passing over heating rollers preferably kept at a temperature of less than 200° C.

In the case of a cellulose-derivative fibre, it is also possible to treat the washed, but not dried, fibre directly via regeneration baths, for example in an aqueous sodium hydroxide solution, in order to regenerate the cellulose and to arrive, after washing and drying, at a regenerated cellulose fibre.

III. EXAMPLES OF EMBODIMENT

The following examples, whether or not in accordance with the invention, are examples of the production of fibres by spinning liquid-crystal cellulose or cellulose formate solutions; these known solutions are prepared in accordance with the description of Section II above.

In all these examples, unless otherwise indicated, the percentages of the compositions of the solutions or of the coagulating agents are percentages by total weight of solution or coagulating agent, respectively. The pH values indicated are the values measured on a pH meter.

TEST 1

In this first test, a liquid-crystal solution of cellulose formate is prepared from 22% of powdered cellulose (initial DP 600), 61% orthophosphoric acid (99% crystalline) and 17% formic acid. After dissolution (1 hour's mixing), the cellulose has a DS (degree of substitution) of 33% and a DP (degree of polymerisation, measured in known manner) of about 480.

The solution is then spun, unless indicated otherwise, under the general conditions described in §II-2. above, through a spinneret formed of 250 holes (capillaries of 65 μm diameter), at a spinning temperature of about 50° C.; the liquid veins thus formed are drawn (spin-stretch factor equal to 6) in a 25 mm air-gap, and then are coagulated in contact with various coagulating agents (depth covered: 30 mm), whether or not in accordance with the invention, without using a surfactant. The cellulose formate fibres thus obtained are washed in water (15° C.), then sent continuously to a regeneration line, at a speed of 150 m/min, to be regenerated thereon in an aqueous sodium hydroxide solution at ambient temperature (sodium hydroxide concentration: 30% by weight), washed with water (15° C.) and finally dried by passing over heating cylinders (180° C.) to adjust their moisture content to less than 15%.

The regenerated cellulose fibres (DS less than 2%) thus obtained have a linear density of 47 tex for 250 filaments (that is to say about 0.19 tex per filament), and the following mechanical properties:

Example 1A: with a coagulating agent not in accordance with the invention, formed of water only, used at a temperature Tc of 20° C.:
T=34 cN/tex
Im=1430 cN/tex
Eb=5.1%.

Example 1B: with a coagulating agent in accordance with the invention, formed of an aqueous solution containing 10% of $Na(NH_4)HPO_4$—pH 8.1—kept at a temperature Tc of 20° C.:

T=41 cN/tex
Im=1935 cN/tex
Eb=4.7%.

Relative to the control (Example 1A), an increase in toughness of more than 20% and an increase in initial modulus of 35% is noted.

Example 1C: with an aqueous coagulating agent in accordance with the invention, formed of water and 20% of $(NH_4)_2HPO_4$—pH=8.1—used at a temperature Tc of 20° C.:
T=49 cN/tex
Im=1960 cN/tex
Eb=6.4%.

It is noted here that the toughness of the fibre coagulated according to the invention is increased by 44% and its initial modulus by 37%, relative to the control which is coagulated with water only.

Example 1D: with the same coagulating agent as for Example 1A, but used at a temperature Tc close to 0° C. (+1° C.):
T=39 cN/tex
Im=1650 cN/tex
Eb=5.0%.

Example 1E: with the same coagulating agent as for Example 1C, but used at a temperature Tc of 0° C.:
T=52 cN/tex
Im=1975 cN/tex
Eb=4.7%.

The toughness obtained here is greater than 50 cN/tex, improved by 30% over the control which is not in accordance with the invention (Example 1D), the modulus is increased by 20%. It is therefore noted in this test that the toughness and initial modulus can be increased, whether or not the coagulating agent is furthermore in accordance with the invention, by lowering the temperature Tc to values close to 0° C.; nevertheless, the formation of sticking filaments ("married filaments") was observed at such temperatures.

TEST 2

In this second test, a liquid-crystal solution is prepared from cellulose (22%), orthophosphoric acid (66%) and formic acid (12%). After dissolution, the cellulose has a DS of 29% and a DP of about 490. This solution is then spun as indicated for Test 1, unless indicated otherwise, using a coagulating agent according to the invention having the same additive for all the examples: aqueous solutions of $(NH_4)_2HPO_4$, with varying concentrations of additive Ca and temperatures Tc.

The regenerated cellulose fibres (DS between 0 and 1%) thus obtained have a linear density of 47 tex for 250 filaments and the following mechanical properties:

Example 2A: with Ca 2.4%; pH=8.0; Tc=10° C.,
T=48 cN/tex
Im=1820 cN/tex
Eb 5.9%.

Example 2B: with Ca=2.4%; pH=8.0; Tc=20° C.,
T=44 cN/tex
Im=1725 cN/tex
Eb=6.6%.

Example 2C: with Ca=5%; pH=8.0; Tc=10° C.,
T=46 cN/tex
Im=1870 cN/tex
Eb=5.2%.

Example 2D: with Ca=12%; pH=8.1; Tc=0° C.,
T 49 cN/tex
Im=2135 cN/tex
Eb=4.5%.

Example 2E: with Ca=12%; pH=8.1; Tc=20° C.,
T=44 cN/tex
Im=1765 cN/tex
Eb=6.5%.

Example 2F: with Ca=20%; pH=8.2; Tc=1° C.,
T=62 cN/tex
Im=2215 cN/tex
Eb=5.6%.

Example 2G: with Ca=20%; pH=8.2; Tc=30° C.,
T=47 cN/tex
Im=1770 cN/tex
Eb=7.3%.

In this test, it was noted that, starting from the same additive, it is possible to vary the toughness of the fibres from 44 to 62 cN/tex, their initial modulus from 1725 to 2215 cN/tex, simply by acting on the temperature Tc and/or the concentration of additive Ca of the co agulating agent.

TEST 3

In this third test, a liquid-crystal solution is prepared from cellulose (24%), orthophosphoric acid (70%) and formic acid (6%). After dissolution, the cellulose has a DS of 20% and a DP of about 480. This solution is then spun as indicated for test 1, unless indicated otherwise, using various coagulating agents, all according to the invention, the composition, the concentration of additive Ca or the temperature Tc of which vary.

The regenerated cellulose fibres (DS between 0 and 1.5%) thus obtained have a linear density of about 45 tex for 250 filaments (i.e. 0.18 tex per filament on average) and the following properties:

Example 3A: with 10% ethanolamine ($NH_2CH_2CH_2OH$); pH=12.1; Tc=20° C.,
T=43 cN/tex
Im=1855 cN/tex
Eb=4.8%.

Example 3B: with 5% $HCOO(NH_4)$; pH=6.5; Tc=20° C.,
T=41 cN/tex
Im=1805 cN/tex
Eb=5.7%.

Example 3C: with 20% $HCOO(NH_4)$; pH=7; Tc=20° C.,
T=56 cN/tex
Im=2250 cN/tex
Eb=4.8%.

Example 3D: with 10% of $HCOO(NH_4)$+10% of $(NH_4)_2HPO_4$; pH=7.8; Tc=20° C.,
T 52 cN/tex
Im=2135 cN/tex
Eb=5.3%.

Example 3E: with 20% $(NH_4)_2HPO_4$; pH=8.2; Tc=30° C.,
T=51 cN/tex
Im=2035 cN/tex
Eb=5.2%.

TEST 4

In this test, a liquid-crystal solution is prepared in accordance with the description of Section II above and application WO96/09356 referred to above, from 18% powdered cellulose (initial DP 540), 65.5% ortho-phosphoric acid and 16.5% polyphosphoric acid (titrating 85% by weight of $P_2O_5$), that is to say that the cellulose is dissolved directly in the mixture of acids without passing through a derivation stage.

It is possible to proceed in the following manner: the two acids are mixed beforehand, the acidic mixture is cooled to 0° C. then introduced into a mixer having Z-shaped arms which itself has been cooled beforehand to −15° C.; then the powdered cellulose, which has first been dried, is added and mixed with the acidic mixture whilst the temperature of the mixture is kept at a value of at most 15° C. After dissolution (0.5 hours+ mixing), the cellulose has a DP of about 450. This solution is then spun, unless indicated otherwise, as indicated for Test 1 above, with the difference, in particular, that there is no regeneration stage. The spinning temperature is 40° C., and the drying temperature 90° C.

Thus non-regenerated cellulose fibres are obtained, i.e. fibres obtained directly by spinning a cellulose solution, without passing through the successive stages of derivation of the cellulose, spinning of a solution of cellulose derivative, and then regeneration of the fibres of cellulose derivative.

These non-regenerated cellulose fibres have a linear density of 47 tex for 250 filaments, and the following mechanical properties:

Example 4A: with a coagulating agent not in accordance with the invention, consisting of water only, at a temperature Tc of 20° C.:
T=30 cN/tex
Im 1560 cN/tex
Eb=6.4%.

Example 4B: with 20% $(NH_4)_2HPO_4$; pH 8.2; Tc=20° C.,
T=45 cN/tex
Im=1895 cN/tex
Eb=6.4%.

Here an increase of 50% in the toughness and 21% in the initial modulus are observed.

Consequently, it is noted that the coagulating agents according to the invention make it possible to obtain cellulose fibres, of regenerated or of non-regenerated cellulose, the initial modulus and the toughness of which are significantly greater than those obtained using water only as coagulating agent.

In all the above comparative examples, the toughness and the initial modulus are both increased by at least 20% relative to those obtained after simple coagulation in water, the increase possibly reaching 50% in some cases; the initial modulus is very high, with values which may exceed 2000 cN/tex.

Cellulose fibres of the invention were subjected to the bar test described in Section I above, and their performance was compared both with that of conventional rayon fibres and that of fibres having very high mechanical properties obtained by spinning liquid-crystal solutions identical to those used in the above four tests, but after coagulation in acetone (in accordance with applications WO85/05115 and WO96/09356 referred to above).

The cellulose fibres according to the invention have a breaking load degeneration ΔF which is always less than 30%, generally between 5 and 25%, whereas the fibres coagulated in acetone, which have come from the same liquid-crystal solutions, show a degeneration which is greater than 30%, generally between 35 and 45%.

By way of example, after 350 fatigue cycles in the bar test, for a compression ratio of 3.5%, the following breaking load degenerations were recorded:

Example 3C: ΔF=12%;

Example 3E: ΔF=14%;

Example 4B: ΔF=25%;

fibre in accordance with WO85/05115 (T=90 cN/tex; Im=3050 cN/tex): ΔF=38%;

fibre in accordance with WO96/09356 (T=95 cN/tex; Im=2850 cN/tex): ΔF=42%;

conventional rayon fibres (T=43–48 cN/tex; Im=900–1000 cN/tex): ΔF=8–12%.

The cellulose fibres of the invention therefore have a fatigue strength which is clearly greater than that recorded for the fibres obtained from the same liquid-crystal solutions of cellulose materials, but coagulated in known manner in acetone. Furthermore, it was observed that fibrillation was reduced on the fibres of the invention compared with these prior fibres coagulated in acetone.

These fibres of the invention are characterised by a combination of properties which is novel: toughness equal to or greater than, and fatigue strength practically equivalent to, that of a conventional rayon fibre, all combined with an initial modulus clearly greater than that of such a rayon fibre, which may reach 2000 cN/tex or more.

This combination of characteristics is quite unexpected to the person skilled in the art because a fatigue strength practically equivalent to that of a conventional rayon fibre—resulting from a non-liquid-crystal phase—had hitherto been considered as impossible for a cellulose fibre of high modulus resulting from a liquid-crystal phase.

Preferably, the fibre according to the invention complies with at least one of the following relationships:

T>45 cN/tex;

Im>1500 cN/tex;

ΔF<15%, and even more preferably at least one of the following relationships:

T>50 cN/tex;

Im>2000 cN/tex.

This fibre according to the invention is advantageously a cellulose fibre regenerated from cellulose formate, the degree of substitution of the cellulose by formate groups being between 0 and 2%.

Of course, the invention is not limited to the examples previously described.

Thus, for example, different constituents may possibly be added to the base constituents previously described (cellulose, formic acid, phosphoric acids, coagulating agents), without changing the spirit of the invention.

The additional constituents, preferably ones which are chemically non-reactive with the base constituents, may, for example, be plasticisers, sizes, dyes, polymers other than cellulose which are possibly capable of being esterified during the production of the solution; these may also be products making it possible, for example, to improve the spinnability of the spinning solutions, the use properties of the fibres obtained or the adhesiveness of these fibres to a rubber matrix.

The expression "cellulose formate" as used in this document covers cases in which the hydroxyl groups of the cellulose are substituted by groups other than formate groups in addition to the latter, for instance ester groups, particularly acetate groups, the degree of substitution of the cellulose by these other groups being preferably less than 10%.

The expressions "spinning" or "spun articles" must be taken very generally, these expressions relating to both fibres and films, whether obtained by extrusion, in particular through a spinneret, or by pouring liauid-crystal solutions of cellulose materials.

In conclusion, owing to their level of properties and the simplified process for obtaining them, the fibres of the invention are industrially advantageous both in the field of industrial fibres and in the field of textile fibres.

What is claimed is:

1. A cellulose fiber having:

a toughness T of greater than 40 cN/tex;

an initial tensile modulus Im of greater than 1200 cN/tex; and a breaking load degeneration ΔF after 350 fatigue cycles in a bar test, at a compression ratio of 3.5% and a tensile stress of 0.25 cN/tex, of less than 30%.

2. The fiber according to claim 1, wherein at least one of the following relationships applies:

T>45 cN/tex;

Im>1500 cN/tex;

ΔF<15%.

3. The fiber according to claim 2, wherein at least one of the following relationships applies:

T>50 cN/tex;

Im>2000 cN/tex.

4. The fiber according to claim 1, wherein the fiber is made of cellulose regenerated from cellulose formate, the degree of substitution of the cellulose with formate groups being between 0 and 2%.

5. An article made of rubber or plastic reinforced by at least one cellulose fibre according to claim 1.

6. The article of claim 5, wherein the article is a tire.

* * * * *

UNITED STATES PATENT AND TRADEMARK OFFICE

CERTIFICATE OF CORRECTION

PATENT NO. : 6,427,736 B1
DATED : August 6, 2002
INVENTOR(S) : Meraldi et al.

It is certified that error appears in the above-identified patent and that said Letters Patent is hereby corrected as shown below:

Title page,
Item [57], ABSTRACT,
Line 10, "$(NH4)_2HPO_4$." should read -- $(NH_4)_2HPO_4$. --

Column 1,
Line 41, "¶U.S." should read -- U.S. --

Column 10,
Line 20, "co agulate" should read -- coagulate --

Column 12,
Line 66, "liauid-crystal" should read -- liquid-crystal --

Column 13,
Line 13, "¶at" should read -- at --

Column 14,
Line 14, "fibre" should read -- fiber --

Signed and Sealed this

Twenty-third Day of September, 2003

JAMES E. ROGAN
*Director of the United States Patent and Trademark Office*